US005154120A

United States Patent [19]

Simeth

[11] Patent Number: 5,154,120

[45] Date of Patent: Oct. 13, 1992

[54] REDUCED FRICTION PLATE CYLINDER AND PRINTING PLATE

[75] Inventor: Claus Simeth, Offenbach am Main, Fed. Rep. of Germany

[73] Assignee: Man Miller Druckmaschinen GmbH, Geisenheim, Fed. Rep. of Germany

[21] Appl. No.: 606,751

[22] Filed: Nov. 2, 1990

[30] Foreign Application Priority Data

Nov. 2, 1989 [DE] Fed. Rep. of Germany ..... 3936448

[51] Int. Cl.[5] ..... B41F 13/10

[52] U.S. Cl. ..... 101/375; 101/378; 101/415.1; 101/DIG. 36

[58] Field of Search ..... 101/375, 378, 401.1, 101/401.3, 479, 415.1, DIG. 36; 33/619, 620, 621

[56] References Cited

U.S. PATENT DOCUMENTS 2,821,026 1/1958 Moggridge ..... 101/DIG. 36

4,178,402 12/1979 Klapproth ..... 101/401.1 X

*Primary Examiner*—Edgar S. Burr

*Assistant Examiner*—Moshe I. Cohen

*Attorney, Agent, or Firm*—Spencer, Frank & Schneider

[57] ABSTRACT

A plate cylinder wherein at least two thin sheets are disposed between the plate cylinder and its printing plate. These thin sheets each have surfaces with different coefficients of sliding friction. The smoother sides of the thin sheets lie on top of one another and the rougher sides lie against the surface of the cylinder and the underside of the printing plate, respectively. Thus the friction between the cylinder and the printing plate is reduced considerably, thereby facilitating retightening of the printing plate on the plate cylinder as well as aligning the printing plate to come into register.

2 Claims, 1 Drawing Sheet

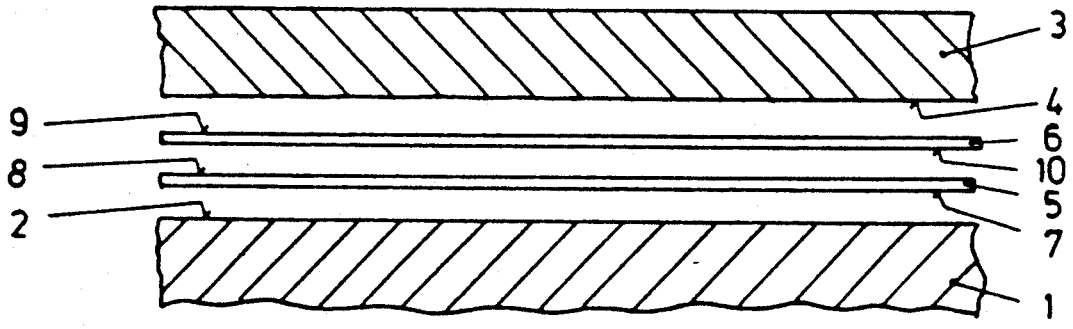
3
4
9
6
8
10
5
2
7
1

REDUCED FRICTION PLATE CYLINDER AND PRINTING PLATE

BACKGROUND OF THE INVENTION

1. Field of the Invention

This invention relates to a plate cylinder of a printing press, wherein the plate cylinder includes a printing plate clamped onto its circumference and an arrangement of thin sheets provided between the plate cylinder and the printing plate.

2. Description of the Prior Art

Conventionally, a support sheet composed, for example, of oiled paper, is arranged between the plate cylinder and the printing plate. However, this prior art arrangement is still distinguished by a very large amount of friction between the actual plate cylinder and the printing plate caused, in particular, by the rough surface of the plate cylinder resting on the relatively rough surface of the oiled paper and also the rough underside of the printing plate resting on the upper face of the support sheet which has the same roughness as its underside. For explanation, it should be mentioned that when a printing plate is tightened by way of a tensioning strip at an end-of-printing location, a force arrives at the start-of-printing location which is only about one fifth of the force at the end-of-printing location of the printing plate. The remainder of the force is lost due to friction. After retightening by way of the tensioning strip at the start-of-printing location, the force at the tensioning strip at the start-of-printing location is approximately equal to 0.6 times the force at the end-of-printing location. Here again, the remainder, that is, about 40% of the force, is lost due to friction.

However, this high coefficient of friction between the plate cylinder and the printing plate is a drawback, particularly if the printing plate is to be retightened on the plate cylinder or is to be otherwise aligned to come into registration. In this connection it must also be considered that only limited forces should act on the printing plate in order not to unduly deform it.

SUMMARY OF THE INVENTION

It is an object of the present invention to provide a plate cylinder having the above-mentioned features which is distinguished by a noticeably reduced coefficient of friction between the plate cylinder and the printing plate, thus avoiding the described drawbacks.

To achieve this and other objects, the invention comprises a plate cylinder, a printing plate, clamped onto a circumference of the plate cylinder and an arrangement of thin sheets or foils. The arrangement of thin sheets comprises at least two thin sheets whose one face has a lower coefficient of sliding friction than the other face, with the two thin sheets being placed on top of one another at their faces having the smaller coefficient of sliding friction.

Thus the lower thin sheet lies with its higher coefficient of sliding friction on the upper face of the plate cylinder, and the face of the upper thin sheet having the higher coefficient of sliding friction lies against the underside of the printing plate. Both thin sheets lie against one another with their easily sliding faces and permit displacement of the printing plate relative to the plate cylinder with low sliding friction, i.e. they slide easily. The above-described drawbacks, particularly in connection with tightening and adjusting the printing plate on the plate cylinder, are thus avoided.

The arrangement of thin sheets may be supplemented by additional thin sheets or foils, for example by support sheets as employed in the prior art between the upper one of the described thin sheets and the underside of the printing plate and/or between the plate cylinder and the lower one of the described thin sheets. Thus it is possible, for example, to enlarge the circumference of the plate cylinder. All this is covered by the invention.

It should also be mentioned that the term thin sheet as employed above and hereinafter includes planar, flexible structures in the broadest sense, for example, those made of plastic, textiles, paper, etc. The only important factor is that the faces of the thin sheets have different coefficients of sliding friction in the sense of the solution to the problem on which the invention is based.

For example such thin sheets may be employed which are coated with plastic on one side, for example with Teflon. Such plastics are distinguished by low coefficients of friction, that is, by good sliding properties. The other side of the thin sheet remains uncoated and has the coefficient of sliding friction of its basic material which, in any case, is higher than the coefficient of sliding friction of the coated side, particularly because this uncoated face retains its normal roughness.

BRIEF DESCRIPTION OF THE DRAWINGS

The above and other objects, effects, features and advantages of the present invention will become more apparent from the following description of embodiments thereof taken in conjunction with the accompanying drawings.

FIG. 1 is a schematic sectional view, of a plate cylinder according to the invention, with the various components being shown spaced from one another for better understanding.

DETAILED DESCRIPTION OF THE PREFERRED EMBODIMENTS

The present invention will hereunder be described in more detail with reference to the following embodiments.

A plate cylinder 1 is provided with a surface having a defined roughness.

A printing plate 3 whose underside has a defined roughness 4 is clamped onto plate cylinder 1.

Between plate cylinder 1 and printing plate 3, there are disposed a lower thin sheet or foil 5 and an upper thin sheet or foil 6. The underside 7 of lower thin sheet 5 has a greater roughness than its upper face 8. Correspondingly, upper face 9 of upper thin sheet 6 has a greater roughness than underside 10 of upper thin sheet 6. In other words, facing and contacting faces 8 and 10 of thin sheets 5 and 6, respectively, slide easily while oppositely disposed faces 7 and 9 are noticeably rougher. Faces 2 and 4 also have a noticeable roughness.

In operation, the layers lie closely above one another, and printing plate 3, with upper thin sheet 6 in contact therewith, can easily be displaced relative to plate cylinder 1 and lower thin sheet 5 in contact with it.

For example, the rougher sides 7 and/or 9 are self-adhesive so that at least one of thin sheets 5 and 6 sticks to plate cylinder 1 or printing plate 3, respectively.

The easily sliding faces 8 and 10 are preferably realized by an appropriate plastic coating of thin sheets 5 and 6.

An additional thin sheet or sheet may possibly be disposed between faces 2 and 7 and/or 4 and 9, if this should be required in order, for example, to enlarge the circumference of the plate cylinder. It is therefore also possible to additionally provide thin sheets having the characteristics according to the invention or also conventional thin sheets.

The invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as may fall within the true spirit of the invention.

What is claimed is:

1. An apparatus for a printing press, comprising:

a plate cylinder;

a printing plate, clamped onto a circumference of said plate cylinder; and an arrangement of foils provided between said plate cylinder and said printing plate, wherein said arrangement of foils comprises two foils each having a first and a second face, said first face having a smaller coefficient of sliding friction than the coefficient of sliding friction of said second face, and the two foils being placed on top of one another without the use of any adhesive and with said first faces facing each other.

2. The apparatus according to claim 1, wherein said foils are each coated with plastic on said first face.

* * * * *